US010629171B1

(12) United States Patent
Haines-Eitzen

(10) Patent No.: US 10,629,171 B1
(45) Date of Patent: Apr. 21, 2020

(54) TONE AND PLAYING RESPONSE ADJUSTER FOR STRINGED MUSICAL INSTRUMENTS

(71) Applicant: John Haines-Eitzen, Brooktondale, NY (US)

(72) Inventor: John Haines-Eitzen, Brooktondale, NY (US)

( * ) Notice: Subject to any disclaimer, the term of this patent is extended or adjusted under 35 U.S.C. 154(b) by 0 days.

(21) Appl. No.: 16/397,174

(22) Filed: Apr. 29, 2019

Related U.S. Application Data

(60) Provisional application No. 62/786,946, filed on Dec. 31, 2018.

(51) Int. Cl.
*G10D 3/12* (2020.01)
*G10D 3/00* (2020.01)

(52) U.S. Cl.
CPC ..... *G10D 3/12* (2013.01); *G10D 3/003* (2013.01)

(58) Field of Classification Search
CPC ..... G10D 3/12; G10D 3/003
See application file for complete search history.

(56) References Cited

U.S. PATENT DOCUMENTS 440,882 A * 11/1890 Lorang ..... G10D 3/06 84/293
576,606 A * 2/1897 Nichols ..... G10D 3/12 84/300
1,182,687 A * 5/1916 Kershner ..... G10D 3/12 84/300
1,462,359 A * 7/1923 Winship ..... G10D 3/12 84/300
1,566,745 A * 12/1925 Grover ..... G10D 3/12 84/301
1,589,755 A * 6/1926 Grover ..... G10D 3/12 84/300
1,615,152 A * 1/1927 Weymann ..... G10D 3/12 84/300
D191,139 S * 8/1961 Baker ..... D17/21
4,171,660 A * 10/1979 Kingsbury ..... G10D 3/12 84/297 R
4,334,455 A * 6/1982 Beecher ..... G10D 3/12 84/297 R
4,867,029 A * 9/1989 Lorenzen ..... G10D 1/02 84/277
6,107,553 A * 8/2000 Deering ..... G10D 3/12 84/300
6,635,812 B2 * 10/2003 Roth ..... G10D 3/12 84/297 R (Continued)

*Primary Examiner* — Robert W Horn

(57) ABSTRACT

This invention comprises a novel mechanical system for adjusting downward and side-to-side pressure of strings on the bridge of stringed musical instruments. The system comprises a threaded female element, to which an instrument's tailgut is attached, and a threaded mounting bolt which freely spins in a socket joint, which is incorporated into a mounting bracket secured to the instrument's end block, thereby allowing the tailgut's position at the point of the saddle to be adjusted higher, lower, or side-to-side relative to the instrument's table. These features allow the instrument's volume, resonance, and playing response to be adjusted in small increments, without detuning the instrument, to allow musicians to adapt quickly to different environmental playing conditions and musical repertoire.

8 Claims, 3 Drawing Sheets

(56) References Cited

U.S. PATENT DOCUMENTS

| | | | | |
|---|---|---|---|---|
| 7,304,225 | B2 * | 12/2007 | Ricci | G10D 3/12 84/302 |
| 8,629,338 | B2 * | 1/2014 | Sterner | G10D 3/12 84/300 |
| 9,495,941 | B2 * | 11/2016 | Stanley | G10D 3/12 |
| 9,984,666 | B1 * | 5/2018 | Knight | G10D 3/12 |
| 2002/0144585 | A1 * | 10/2002 | Potter | G10D 1/10 84/300 |
| 2017/0249928 | A1 * | 8/2017 | Kuo | G10D 3/12 |

* cited by examiner

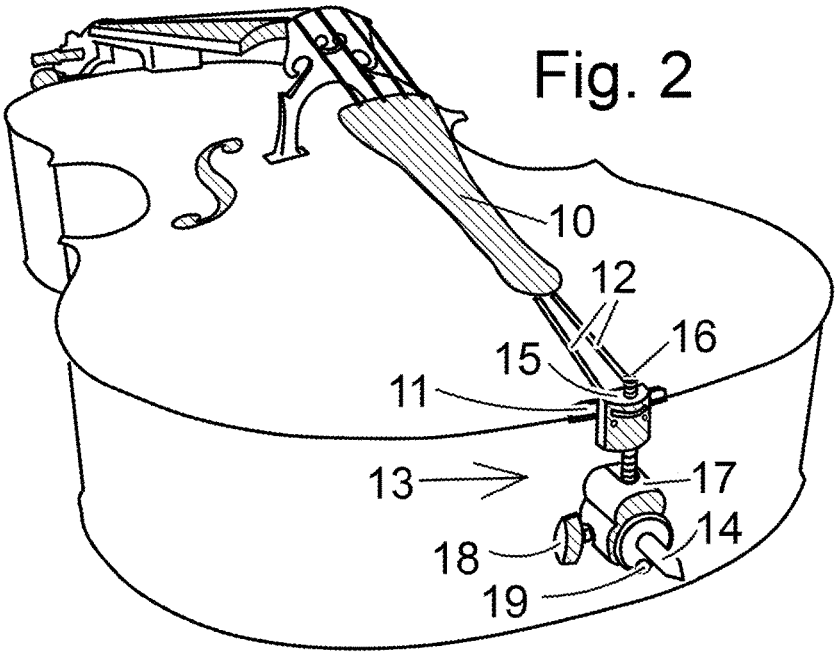
Fig. 2
Fig. 3
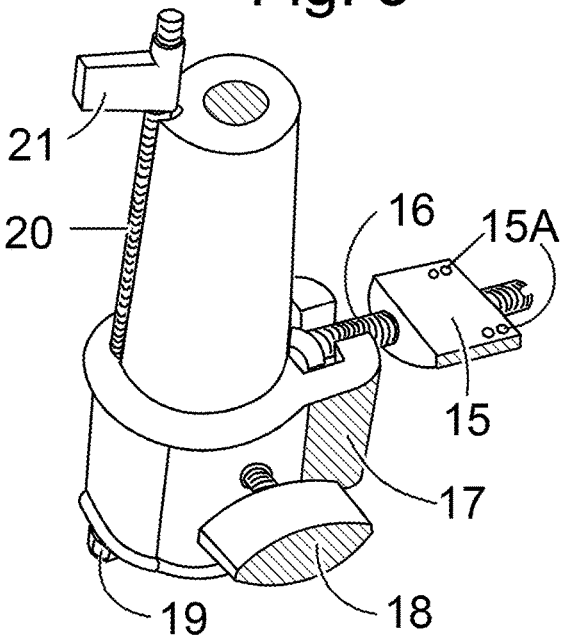
Fig. 4
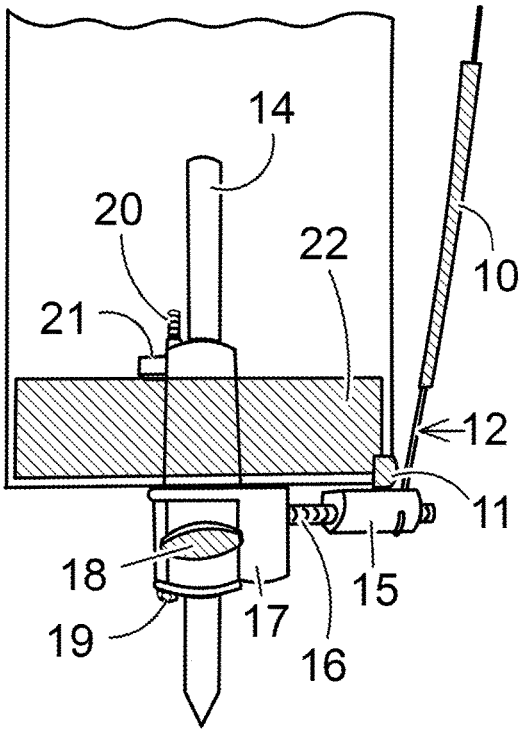

TONE AND PLAYING RESPONSE ADJUSTER FOR STRINGED MUSICAL INSTRUMENTS

RELATED APPLICATION

This application claims the benefit of U.S. Provisional Patent Application 62/786,946, filed Dec. 31, 2018, the entire contents of which are incorporated herein by reference.

FIELD OF THE INVENTION

This invention relates to novel string positioning and mounting systems for stringed musical instruments that have a raised bridge, over which strings pass, which transmits downward pressure on the body of the instrument, through which the transmitted string vibrations create sound. More particularly, the invention relates to tonal and playing response adjusters for said stringed instruments.

BACKGROUND OF THE INVENTION

Description of Related Art

Violin-family stringed instruments (violins, violas, cellos, and double basses), and other stringed musical instruments which operate in a mechanically similar manner, are made of many moving parts. These parts, frequently made of wood, are perpetually in a state of expansion and contraction as they are exposed to daily changes in temperature and humidity. Sometimes these changes are small and do not affect the tone or playability of the instrument, but often they are large enough to affect an instrument's sound in a negative way, creating challenges for musicians seeking to play at a high level.

Throughout the history of stringed musical instrument development, musicians and luthiers (stringed instrument makers) have devised multiple ways to adjust the tuning, tone, and playability of these instruments in response to this environmental variability as well as artistic considerations (e.g. musicians seeking a different sound for changes in musical repertoire). These developments include adjustable height bridges and a variety of types of "sound posts" (supportive wooden or carbon fiber dowels inside the body of violin-family stringed instruments), as well as many other design and feature changes to help improve instruments' functionality.

One instrument component that has usually been overlooked as a tonal adjuster is the saddle. The saddle is a small strip of durable material, usually made of ebony or another hardwood or plastic, glued to the interior supportive "end block" where an instrument's strings re-engage with its body after passing over the bridge. Certain styles of guitars and have traditionally used saddles that have some adjustability, but this adjustability is generally related to pitch stability and not tonal quality. Some banjos have tailpieces that allow string tension to be varied, but the design of those components doesn't function well with violin-family instruments which have much higher string tension. Some double bass players have devised methods to raise the height of their saddles to improve the sound of their instruments, but these methods have almost always required loosening an instrument's strings and subsequently retuning it to make any tonal changes, and also a good deal of guesswork to optimize the adjustment. Because double bass strings can exert a cumulative pulling force of 280 pounds on the saddle, most of the methods bass players use to raise their saddles require strong screws and drilling extra holes in the body of an instrument, a practice frowned on by many luthiers.

Two patents which present advances in tonal adjustability for violin-family instruments in a manner related to the invention presented here are U.S. Pat. Nos. 4,334,455A and 7,304,225B2. Both of these inventions share a common design shortcoming in that they put clamping pressure on the top ("table") of an instrument, which is designed to vibrate freely when the instrument is played, thereby inhibiting the table's vibrations. This clamping of the table can improve playing response in certain instruments, but almost always reduces resonance and volume. Luthiers, from Stradavarius onward, have designed their instruments to function as an integrated whole, and impeding that functioning by damping spots on the vibrating table generally has negative acoustical side-effects. Another weakness of these two inventions is the possibility that they may scratch the varnish or indent the soft spruce wood of an instrument's table—something to be carefully avoided when dealing with priceless antique stringed instruments. U.S. Pat. No. 7,304,225B2 also shares a design shortcoming present in most double bass raised saddle designs currently used in the field: They require detuning the instrument before changing the adjustment because of the leveraged string tension on the tailgut (the cord or wire which supports the tailpiece and strings) and instrument table. U.S. Pat. No. 7,304,225B2 includes multiple variations, and in these variations, the closer the tailpiece adjustment screws are to the saddle, the greater the degree of detuning required when making tonal adjustments.

The novel "Tone and Playing Response Adjuster for Stringed Musical Instruments" presented in this document addresses the design weaknesses of these previous inventions in several ways. Unlike U.S. Pat. Nos. 4,334,455A and 7,304,225B2, the invention presented here touches an instrument with minimal contact area, and only on the hardwood saddle. This saddle is the stringed instrument component traditionally designed to support the intense pulling pressure of an instrument's tailgut without risking physical damage or acoustical impedance to the softwood top ("table"). Unlike U.S. Pat. Nos. 4,334,455A and 7,304,225B2, the invention presented here also introduces side-to-side adjustability for treble and bass adjustments in addition to height adjustments for overall resonance and volume. Also, it provides a method of securing the saddle adjuster to the interior end block of an instrument by functioning as a lever, with the saddle serving as fulcrum, in a way that reduces torque on the end block and won't rattle or vibrate loose (a scenario possible with U.S. Pat. No. 4,334,455A because it doesn't include a locknut for the endpin mounting bracket to secure it into the end block).

SUMMARY OF THE INVENTION

The purpose of this invention is to allow players of stringed instruments to adjust the tone and playing response of their instruments in response to environmental changes in temperature and humidity and to adapt to the aesthetic requirements of different musical repertoire. The invention accomplishes this adjustability through an assembly of components comprising those described in this summary of the invention.

In the assembly, a threaded female component, to which an instrument's tailgut is attached, rests on the lower edge of the instrument's saddle. This component is heretofore referred to as "saddle rider" for brevity because of the way it rests or "rides" on the saddle in an adjustable manner. The saddle rider is attached to a threaded mounting bolt, which connects it to a socket joint on the instrument's end button or endpin that allows the mounting bolt to rotate freely. For clarity, the socket joint component is heretofore called the "mounting bracket," whether referring to a modified endpin mount (in the case of cellos or double basses), modified end button mount (in the case of violins and violas), or a discrete eye-nut assembly which independently connects the mounting bolt to the end block of the instrument. To secure the mounting bracket into the end block, a T-shaped or L-shaped lock nut and screw assembly is employed. This "mounting bracket lock nut assembly" is inserted through a channel or hole in the mounting bracket and holds the mounting bracket securely in a hole in the end block, at the same time allowing the mounting bracket to rotate freely in the end block hole.

The system comprising these components allows an instrument's tone and playing response to be adjusted by varying the downward and side to side pressure of the instrument's strings on its bridge. Tightening the saddle rider mounting bolt with a screwdriver, Allen wrench, or a coin such as a United States Quarter (which works as an adjusting key for the cello version of this invention) increases the strings' downward pressure, thereby increasing the instrument's volume and focus. Loosening the bolt decreases volume, but increases richness of tone and agility of playing response. Moving the saddle rider component from side to side changes the relative volume of the instrument's treble and bass tonal registers.

Front view of a cello showing an overview of the location where the invention presented in this document contacts the body of the instrument

FIG. 2:

Closer view of the invention as it attaches to a cello

FIG. 3:

Interior view of the invention

FIG. 4:

Side view of invention showing how it is inserted through a hole in an instrument's end block

FIG. 5:

View of a violin showing alternative design of the invention for violins and violas

FIG. 6:

View of a traditional stringed instrument tailgut as it wraps around the end button for reference to prior art

DETAILED DESCRIPTION OF THE INVENTION

Figure 1:
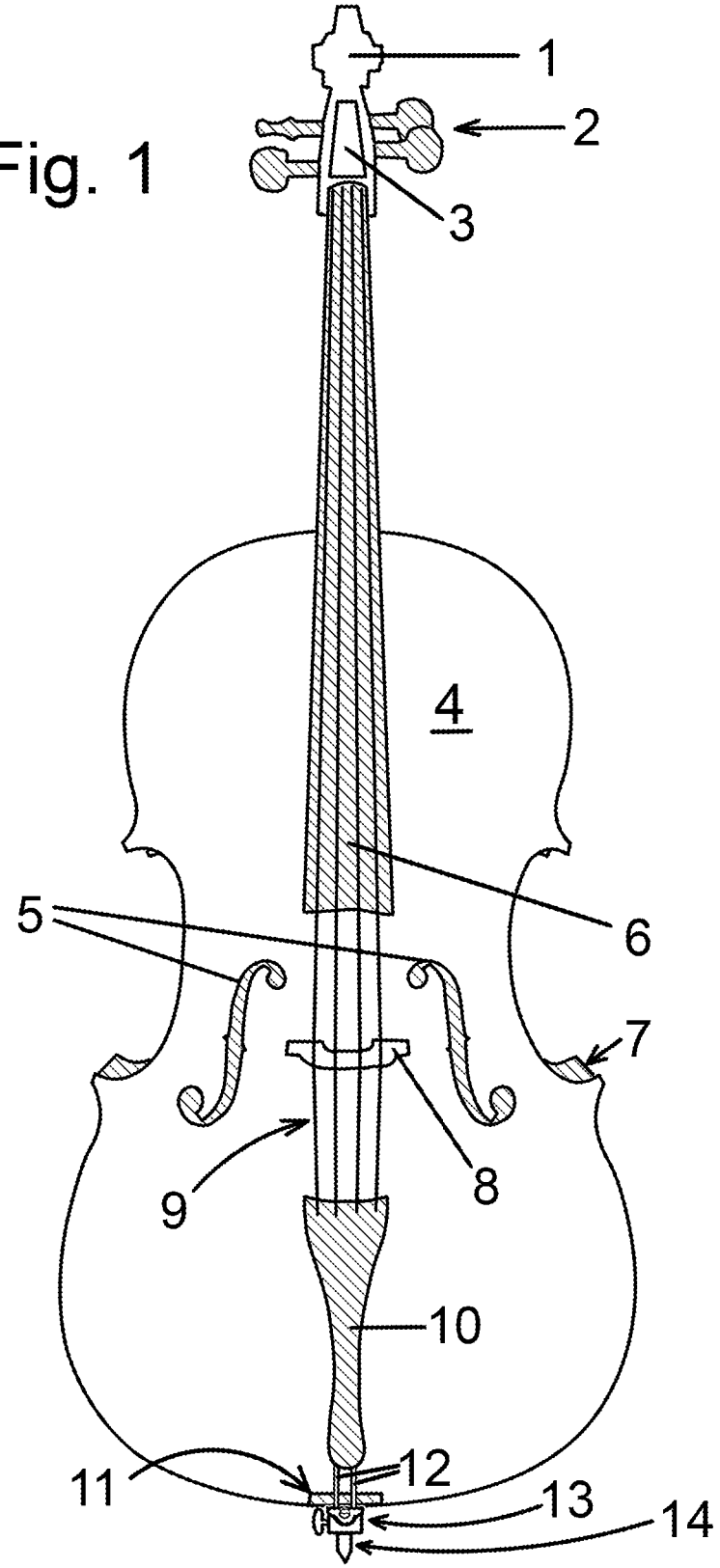
FIG. 1.

This invention comprises a mechanical system for raising or lowering downward pressure of strings on the bridge of musical instruments in the violin family (violins, violas, cellos, and double basses), as well as other stringed instruments that operate in a mechanically similar manner. With reference to FIG. 1, the aforementioned stringed instruments create sound via strings (9) attached to pegs (2) in a pegbox (3) at the head or "scroll" of the instrument (1). The tightened strings travel over the fingerboard (6) and bend over a bridge (8) before attaching to the tailpiece (10). The tailpiece, in turn, connects to the body (4) of the instrument via a tailgut (12) made of strong cord or wire which passes over the saddle (11), which is a piece of hardwood or hard plastic designed to support significant tailgut pressure and abrasion. The saddle is traditionally glued to the instrument's interior end block as shown in FIG. 4 (22). Because these instrument parts, and others, are subject to expansion and contraction with environmental expansion and contraction due to temperature and humidity changes, the angle of the strings over the bridge is in a perpetual state of change. This change, albeit subtle, is enough to affect the tone and playability of the instrument from day to day. By allowing the angle of the strings over the bridge to be adjusted in four directions (higher, lower, or side-to-side along a plane perpendicular to the table of the instrument), this invention allows the tone of the instrument to be changed in small increments. Relative to the top, or "table," of the instrument which supports the bridge, the higher the tailgut is adjusted (resulting in strings bending less over the bridge and applying less downward pressure), the more resonant the tone of the instrument and the more agile the playing response. As the tailgut is adjusted downward towards the table, the instrument projects with more power and focus. Side-to-side adjustments change the relative bass and treble tone and playing response of the instrument.

This invention accomplishes directional adjustability of the tailgut through an assembly of components comprising: A threaded female component, or "saddle rider" (15), that rests on the lower edge of an instrument's saddle to which an instrument's tailgut is attached; A "saddle rider mounting bolt" (16) that secures the saddle rider to the instrument's specially-designed end button, endpin mount, or a similar mounting; A modified endpin mount, end button, or similar "saddle rider mounting bracket" (17) specially designed to secure the end of the saddle rider mounting bolt and to allow it to rotate freely; and a "mounting bracket locknut assembly" (21), which holds the saddle rider mounting bracket securely in the instrument's end block, while allowing the mounting bracket to rotate from side to side. Additional bass and treble adjustability is created by extra tailgut holes (15A), which allow the tailpiece to be attached at varying angles favoring an instrument's treble or bass register.

A key aspect of the efficient functioning of this invention is the manner in which the saddle rider component (15), rests on the underside of an instrument's primary saddle (11) with a very small contact area, thereby allow the table of the instrument to vibrate freely when played. Because an instrument vibrates relatively little at the corners (7) and end block (22), where interior blocks of wood support glue joints holding the instrument together, these areas can be touched while an instrument is played without muting the sound. Care should be taken, when installing this invention, that the instrument has a well-constructed and properly glued saddle, and that the saddle rider assembly (13) does not contact the body of the instrument anywhere other than the saddle, which is designed to bear the tailgut pressures which range from 55-280 pounds in violin-family instruments.

Figure 5:
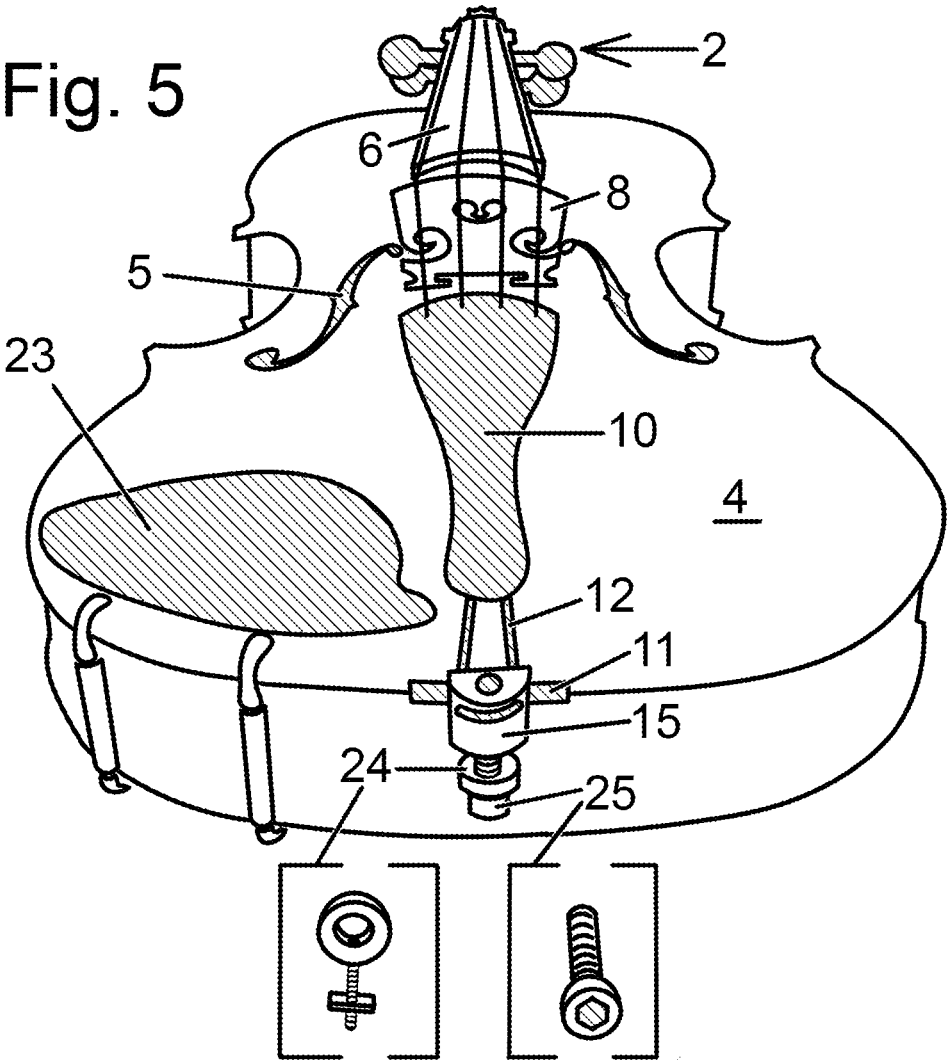

In order to install the saddle rider mounting bracket on an instrument without requiring the removal of the instrument's top, there are different procedures for the violin and viola version (FIG. 5), and the cello and double bass version (FIGS. 2-4). For violins and violas, the mounting bracket locknut assembly is taped to a flexible cord inserted through the end block hole and the instrument's "F hole" (5). Pulling out the cord then pulls the locknut assembly into place by inserting it through the end block hole. For cellos and double basses, which require an endpin (14) and endpin locking screw (18) for support, the specially-designed mounting bracket locknut assembly has a weighted L-shaped locknut. For installation, the locknut is rotated over the plug portion of the assembly to allow easy insertion into the end block hole. Once the mounting bracket assembly is inserted into the hole, the instrument can be set on its back on a table, causing gravity to toggle the L-shaped nut into position for tightening the locking bolt head (19) to rotate the locking bolt (20), thereby securing the assembly in the end block.

Figure 6:
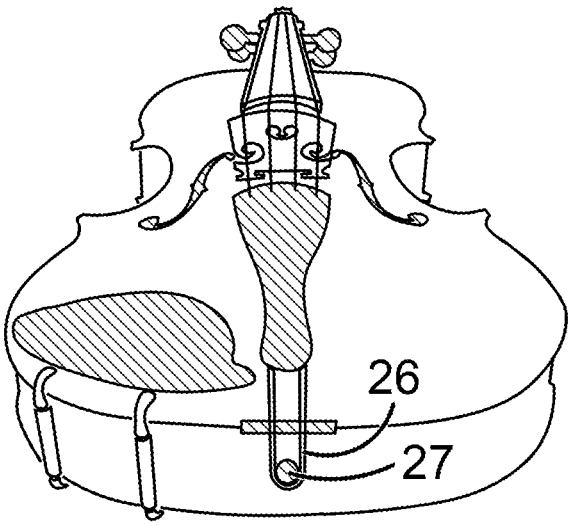

The differing installation procedure for violins and violas is a result of the varied design of the saddle rider assembly for those instruments. This design variation is required because violins and violas are held under the player's chin via a chinrest (23). To give the player as much chin clearance as possible, the violin and viola version of the saddle rider assembly employs an Allen bolt (25) with the bolt head behind the violin and viola mounting bracket (24). To more clearly demonstrate the novel functioning of the saddle rider assembly, a traditional mounting of the tailgut (26) over a traditional end button (27) is shown in FIG. 6.

With regard to the preferred embodiment of this invention, during research and development I have successfully crafted versions out of a variety of materials including wood, metal, and plastic. Because the saddle rider assembly is installed where little vibration occurs, the acoustical differences between the materials are relatively minor. A primary manufacturing consideration is to construct the invention in a way that protects the valuable musical instrument on which it may be installed from accidental damage due to breakage of the saddle rider or its mounting bracket. For constructing these two components, I prefer plastics with high tensile strength, abrasion resistance, and an elongation modulus before fracture of at least 6 percent in all directions. Plastics with these properties tend to offer slight acoustical resonance advantages over metal, wood, and stiffer plastics, and are less likely to fracture unexpectedly if subjected to accidental shocks like those that might occur if an instrument is dropped. The saddle rider assembly's plastic components can be manufactured through injection molding, CNC, or 3D printing (although current iterations of FDM 3D printing technology should generally be avoided because of irregular elongation modulus and tensile strength characteristics in the X, Y, and Z axis). The saddle rider mounting bolt can be manufactured with excellent durability from stainless steel. Mounting bracket T or L nuts may be successfully manufactured out of brass, steel, or titanium. Although plastic T or L nuts may function properly in the short term, because the stakes are high involving valuable stringed instruments, engineering the L and T nut out of brass, steel, or titanium is suggested for long-term durability. The invention will not work properly if the mounting bolt deflects even slightly, so care should be taken to select a mounting bolt with sufficient tensile strength to prevent deflection when subjected to the cumulative string tensions involved (55-280 pounds, depending on the instrument in question).

The invention claimed is:

1. A tone and playing response adjusting device for a stringed musical instrument of the type in which the strings extend over a bridge resting on the table of the instrument and are secured to a tailpiece, comprising adjustable means to change the downward and side-to-side pressure exerted by the strings on the bridge of said instrument, thereby adjusting its tone and playing response, without changing the musical pitch of the strings, wherein the downward and side-to-side tension of the strings on the bridge are controlled by moving a secondary saddle component, to which the instrument's tailgut is attached, which rests on the instrument's primary saddle and can be adjusted in four directions (higher, lower, or side-to-side) along a plane perpendicular to the table of the instrument, by means of a rotating mounting bolt and rotating mounting bracket assembly attached to the end block of the instrument.

2. A tone and playing response adjusting device for stringed instruments, according to claim 1, wherein the downward string tension adjusting means comprises a rotating bolt and nut assembly which acts as a lever when attached to the mounting bracket assembly, with the instrument's saddle acting as a fulcrum, thereby reducing torque on the end block of said instrument.

3. A tone and playing response adjusting device for stringed instruments, according to claim 1, wherein the mounting bracket assembly rotates in a hole in the end block of the instrument and is held in place against the pulling force of the mounting bolt by means of a lock nut.

4. A tailpiece and end block mounting bracket assembly for a stringed musical instrument where said assembly has a tone and playing response-adjusting device, according to claim 1, integrated into its construction.

5. A stringed musical instrument that has a tone and playing response-adjusting device, according to claim 1, integrated into its construction.

6. A tone and playing response-adjusting device for a stringed musical instrument, according to claim 1, wherein the downward pressure exerted by the strings on the bridge of said instrument is adjustable, but the side-to-side pressure is not adjustable.

7. A tone and playing response-adjusting device for a stringed musical instrument, according to claim 1, wherein the side-to-side pressure exerted by the strings on the bridge of said instrument is adjustable, but the downward pressure is not adjustable.

8. A tone and playing response adjusting device for a stringed musical instrument, according to claim 1, wherein the instrument's strings attach directly to the secondary saddle component.

* * * * *